US006076992A

United States Patent [19]

Fukui et al.

[11] Patent Number: 6,076,992

[45] **Date of Patent: *Jun. 20, 2000**

[54] UNDERDRAIN PIPE

[75] Inventors: Kouki Fukui; Yasuhiro Kikumori, both of Osaka, Japan

[73] Assignee: Totaku Industries, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,535

[22] Filed: Apr. 9, 1997

[30] Foreign Application Priority Data

Apr. 10, 1996 [JP] Japan ..... 8-114172

[51] Int. Cl.[7] ..... E02B 11/00; E02B 13/00; F16L 11/00

[52] U.S. Cl. ..... 405/43; 405/36; 405/44; 405/45; 405/49; 138/106; 138/121; 138/177

[58] Field of Search ..... 405/43, 44, 45, 405/46, 49, 78, 36; 138/106, 112, 121, 177, DIG. 11

[56] References Cited

U.S. PATENT DOCUMENTS

| | | | |
|---|---|---|---|
| 970,383 | 9/1910 | McCulloch | 405/45 |
| 2,230,306 | 2/1941 | McDonald | 138/106 |
| 3,693,664 | 9/1972 | Schmunk | 138/121 X |
| 4,624,603 | 11/1986 | Kanao | 405/43 X |
| 4,650,367 | 3/1987 | Dietzler | 405/43 |
| 4,930,936 | 6/1990 | Hegler et al. | 405/44 X |
| 4,950,103 | 8/1990 | Justice | 405/43 |
| 5,120,038 | 6/1992 | Stine | 285/31 |
| 5,799,703 | 9/1998 | Kanao et al. | 138/121 |
| 5,832,960 | 11/1998 | Amatsutsu et al. | 138/110 |
| 5,839,477 | 11/1998 | Murayama | 138/121 |

FOREIGN PATENT DOCUMENTS

| | | | |
|---|---|---|---|
| 2016639 | 9/1979 | United Kingdom | 405/43 |

*Primary Examiner*—Eileen Dunn Lillis
*Assistant Examiner*—Jong-Suk Lee
*Attorney, Agent, or Firm*—Whitham, Curtis & Whitham

[57] ABSTRACT

An underdrain pipe has a pipe wall in which wall portions rectangular in section and wall portions circular in section are disposed alternately in a longitudinal direction of the pipe, in which a number of water collecting small holes are formed in portions of the pipe wall, and in which the whole of the pipe wall is formed of material of synthetic resin or rubber.

22 Claims, 7 Drawing Sheets

UNDERDRAIN PIPE

BACKGROUND OF THE INVENTION

The present invention relates to a water collection and drain pipe which is generally called an underdrain pipe and buried in the ground in use, and particularly relates to a pipe buried in the ground such as prepared grounds for housing, golf links, agricultural land, retaining walls, or banks, and used for collecting rainwater or a spring in the ground, guiding and draining the water to a predetermined drainage channel.

Heretofore, such an underdrain pipe is well known and used broadly. Such a conventional underdrain pipe is generally a cylindrical pipe made of synthetic resin and formed into a spirally corrugated shape. (For example, see Japanese Utility Model Unexamined Publication No. Sho 61-93528)

In the case of such a pipe formed cylindrically, the stability thereof is poor when the pipe is buried and subjected to piping in the ground so that the pipe is apt to be twisted in the circumferential direction of the pipe. Therefore, in the case where small holes for collecting water are formed in the pipe except a predetermined angle region in the circumferential direction of the pipe in order to surely drain water which is once collected in the pipe, even if it is designed in advance so as to dispose the pipe in a manner so that the portion having no small holes comes downside, it is difficult to surely make this portion having no small holes come downside because of such a twisting phenomenon of the pipe. Therefore, a conventional underdrain pipe has a structure that small holes for collecting water are formed over the whole region of the pipe in the circumferential direction of the pipe.

SUMMARY OF THE INVENTION

Taking the foregoing problems in the conventional underdrain pipes into consideration, an object of the present invention is to solve the problems of the conventional underdrain pipes and to provide an underdrain pipe having a special structure, which is at least as easy to manufacture compared to conventional underdrain pipes but which does not have an increased of cost in comparison there to.

In order to solve the above problems, according to the present invention, there is provided an underdrain pipe having a pipe wall in which wall portions rectangular in section and wall portions circular in section are disposed alternately in a longitudinal direction of the pipe, in which a number of water collecting small holes are formed in portions of the pipe wall, and in which the whole of the pipe wall is formed of synthetic resin or rubber.

The sectional shape of a sectionally rectangular wall portion stated herein is not limited to a square, but it may be a rectangle which is long vertically or horizontally. In addition, the sectional shape of a sectionally circular wall portion is not limited to a true circle, but it may be an egg-like shape or an ellipse. In addition, although the sectionally rectangular wall portion may have angled corners, it is convenient in handling to make the corners arcuate.

In carrying out the present invention, the center portion of a flat side in each of the sectionally rectangular wall portions and corresponding part of the sectionally circular wall portions adjacent to this portion may be formed to be substantially even to each other in the inner circumferential surface of a pipe wall. Further, a number of water collecting small holes may be formed only in the sectionally circular wall portions of the pipe wall or only in the sectionally rectangular wall portions. Alternatively, a number of water collecting small holes may be formed in both the sectionally rectangular wall portions and the sectionally circular wall portions. Further, a number of water collecting small holes may be formed only in the circumferential wall portion except a predetermined flat side of each of the sectionally rectangular wall portions and a predetermined angle region $\alpha$ including the flat side in the circumferential direction of the pipe wall 1.

Polyethylene, polyvinyl chloride, polypropylene, other desired synthetic resin materials can be selectively used as the synthetic resin material forming the underdrain pipe according to the present invention. Desired material such as natural rubber and synthetic rubber may be selectively used as the rubber material. Because of a pipe buried in the ground in use, a hard material superior in resistance against flattening pressure is suitable as the material for the pipe.

The thus configured underdrain pipe of the present invention can be subjected to piping stably in a constant posture by the existence of the sectionally rectangular wall portions of the pipe wall. Particularly when the pipe is disposed in a ditch made in the ground, it is possible to position the pipe stably by putting the flat sides of the sectionally rectangular wall portions on the bottom of the ditch, and the pipe is not displaced easily after the pipe is subjected to piping, so that it is easy to keep the posture of the pipe arrangement.

DETAILED DESCRIPTION OF THE INVENTION

Figure 1:
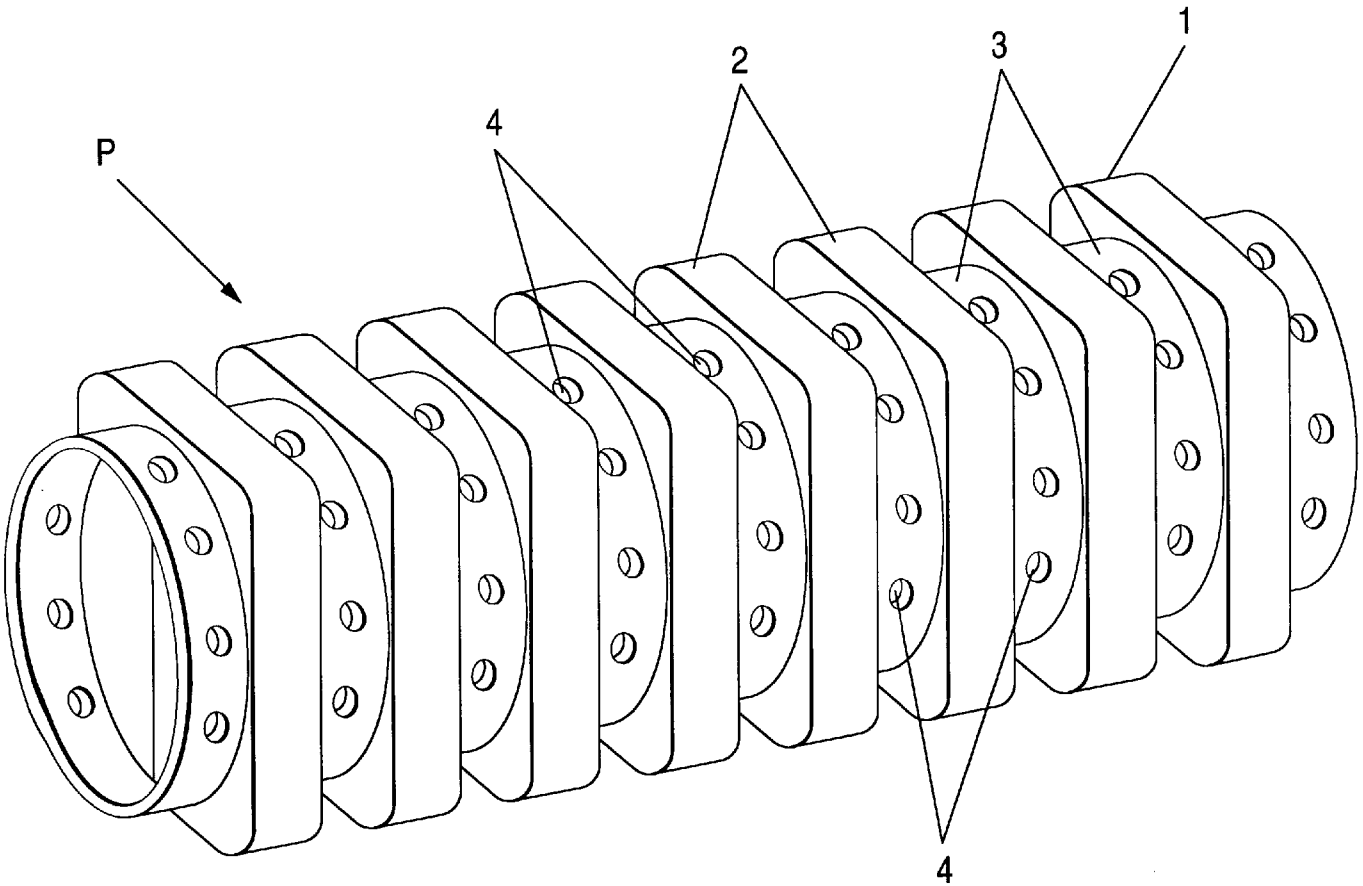
FIG. 1 is a perspective view showing the pipe according to a first embodiment.
Figure 2:
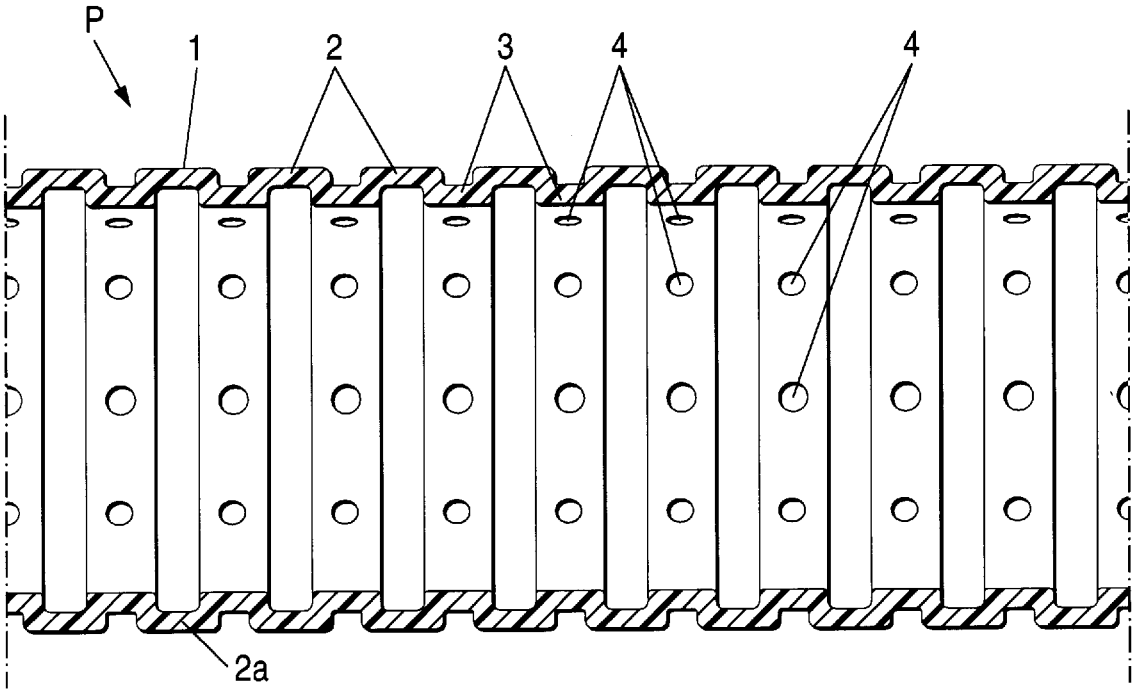
FIG. 2 is a center vertical sectional view taken in the axial direction of the pipe of FIG. 1.
Figure 3:
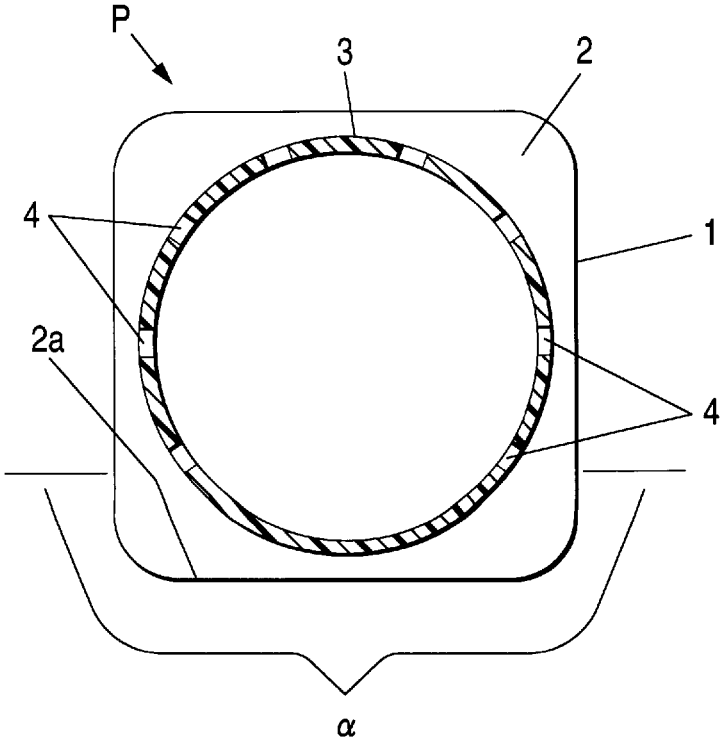
FIG. 3 is a vertical sectional view of a sectionally circular wall portion of the pipe of FIG. 1.

Preferred embodiments of the present invention will now be described with reference to the accompanying drawings. FIGS. 1 to 4 are views showing an underdrain pipe of a first embodiment. FIG. 1 is a perspective view showing the appearance of a pipe P, FIG. 2 shows a state where the center portion of a pipe wall 1 is cut in the longitudinal direction of the pipe, and FIG. 3 shows the state where a sectionally circular wall portion 3 of the pipe wall 1 is cut in the circumferential direction of the pipe.

As shown in these drawings, the pipe P of this embodiment has such a structure that a pipe wall 1 is formed into continuous bellows in which sectionally rectangular wall portions 2, the sectional shape of which is made approximately square, and sectionally circular wall portions 3, the sectional shape of which is made circular, are disposed alternately in the axial direction of the pipe, and a plurality of water collecting small holes 4 are formed in each of the sectionally circular wall portions 3. The present invention may be carried out such that the pipe wall 1 mentioned herein has a spirally continuous corrugated shape in place of such a bellows-like corrugated shape.

Figure 4:
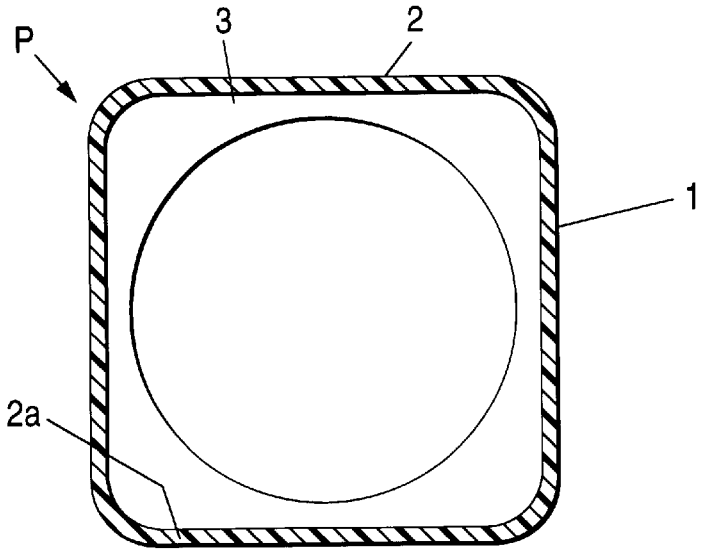
FIG. 4 is a vertical sectional view of a sectionally rectangular wall portion of the pipe of FIG. 1.

The pipe P shown in this embodiment is designed so that the sectional shape of each sectionally rectangular wall portion 2 is a square having rounded corners as shown in FIGS. 1, 3 and 4, and the center portion of a flat side 2*a* of this sectionally rectangular wall portion 2 and a sectionally circular wall portion 3 adjacent to this portion form a bellows-like shape. However, by making at least part of these wall portions 2*a* and 3 substantially continuously even to each other in the inner circumferential surface of the pipe wall 1, as shown in a lower part of FIGS. 10 and 11 it is possible to move water collected in the pipe P smoothly without any stagnation under a low resistance.

In addition, the pipe P shown in this embodiment has such a structure, as shown in FIG. 3, that no water collecting small holes 4 are formed in the portion over a predetermined angle region α, including the portion adjacent to one flat side (lower flat side in FIG. 3) 2*a* of the sectionally rectangular wall portion 2, but the water collecting small holes 4 are formed in the portion other than the portion over this angle region α. Thus, when the pipe is disposed so that this portion of the flat side 2*a* in which the water collecting small holes 4 are not formed is put downside, water once collected in the pipe P can be prevented from being drained again into the ground through water collecting small holes formed in the lower side of the pipe.

In manufacturing the pipe P having such a structure, melted resin is extruded in the form of a tube from a resin extruder arranged on one end of a travelling mold cavity for molding a pipe in a well-known travelling mold system. Pressurized air is blown into the tube, or the air is sucked from the mold simultaneously to thereby mold the melted tube sequentially and continuously while pressing the tube onto the mold. The water collecting small holes 4 may be formed sequentially in a place where the pipe is moved to the outside of the mold, or after the pipe which has been molded is solidified.

Figure 5:
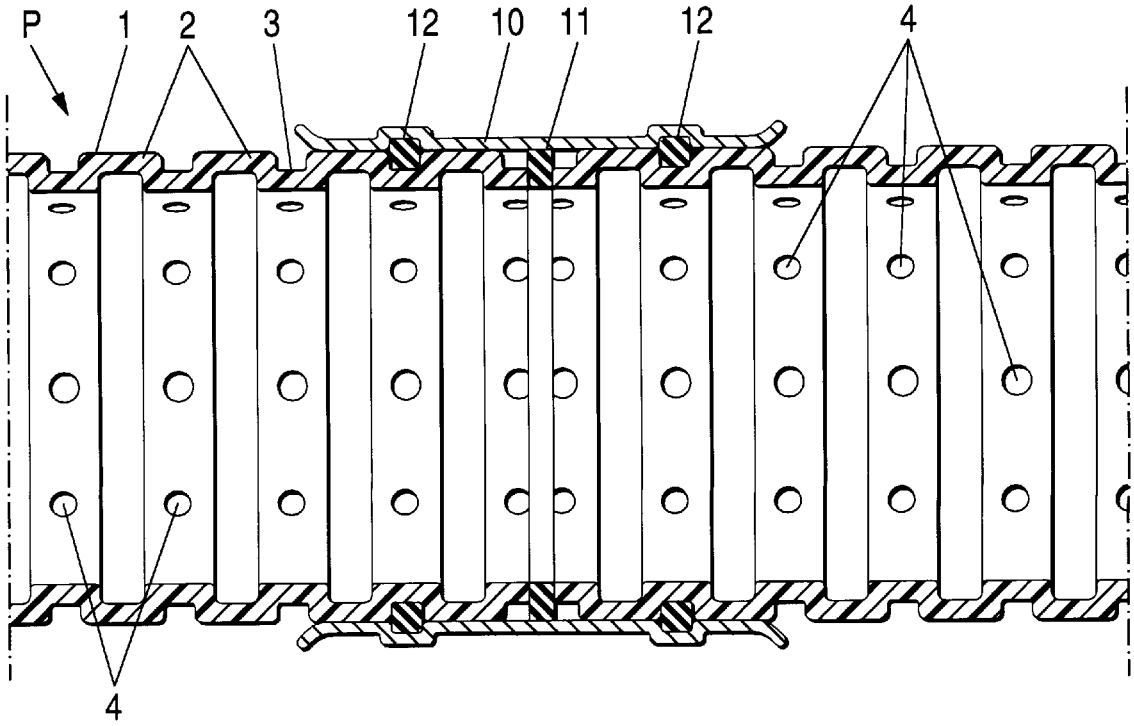
FIG. 5 is a vertical sectional view taken in the pipe axial direction showing a state where the two pipes are connected with each other.

FIG. 5 shows means for connecting the thus configured pipes P and P with each other by use of a pipe joint by way of example. This connecting means is such that packings 12 and 12 superior in rubber elasticity are fitted onto the sectionally circular wall portions 3 near end portions of the pipes P respectively. Each packing 12 has a circular hole with substantially the same shape as the sectionally circular wall portion 3, and has an external shape which is a square similar to the sectionally rectangular wall portion 2 and which is a little larger than the external shape of the sectionally rectangular wall portion 2. Then, another ring-like packing 11 of foamed material, resin, or rubber, to be interposed between the confronted end surfaces of the pipes P and P, is inserted to the center portion of a joint 10 of resin or metal which has end portions in the form of square tube and a center portion in the form of a cylinder. Thereafter, the two pipes P and P are pressed into this joint 10 from its opposite sides to be connected to each other. It is needless to say that the pipes may be connected by another means though the description thereof is omitted here.

Figure 6:
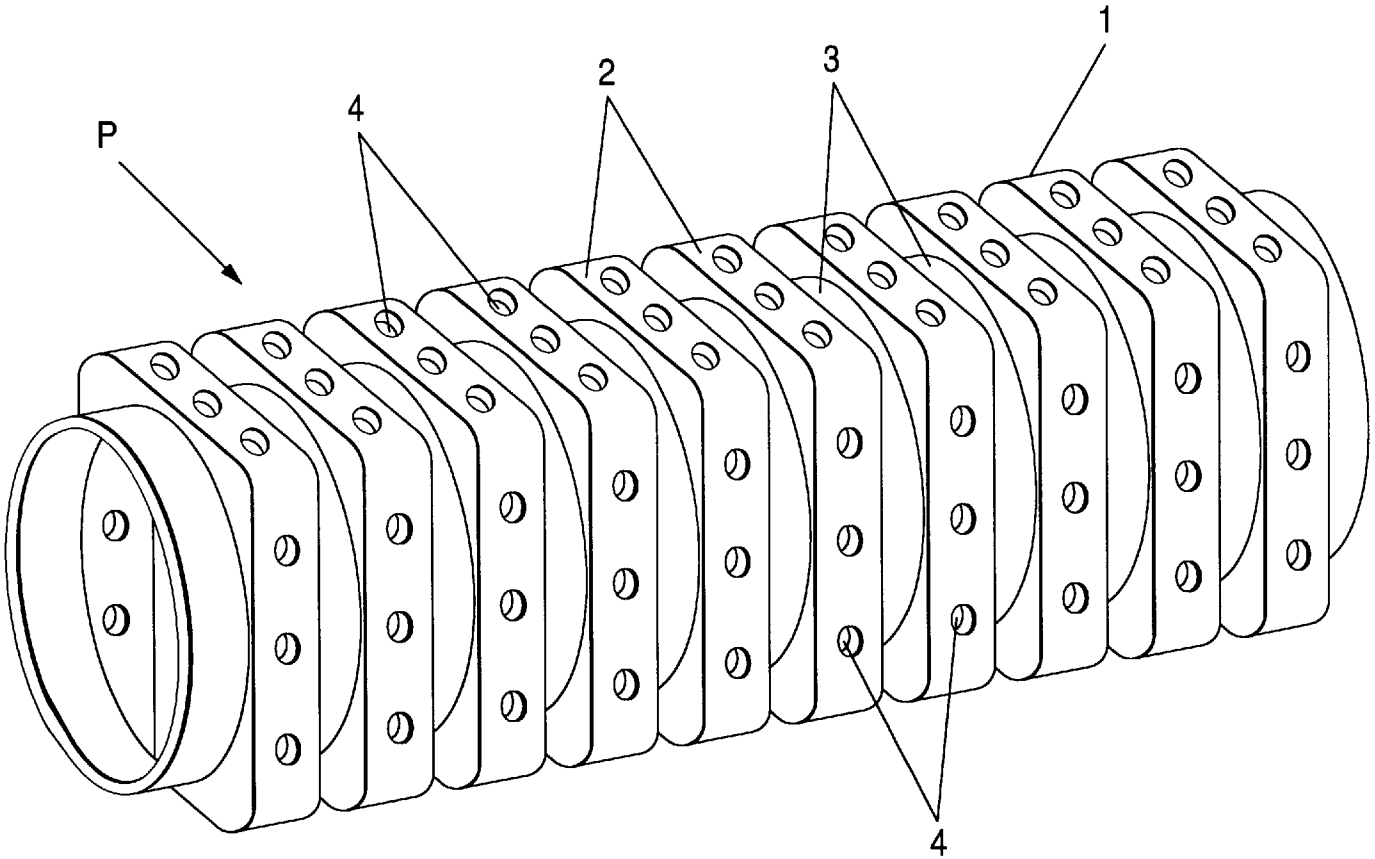
FIG. 6 is a perspective view of a pipe showing a second embodiment.
Figure 7:
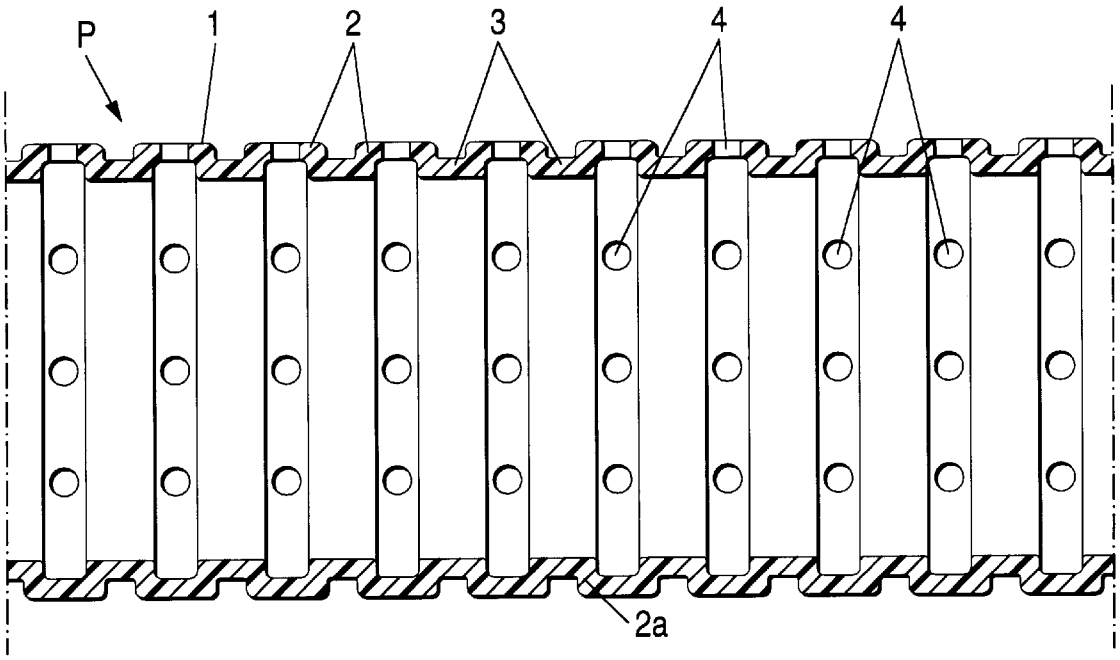
FIG. 7 is a center vertical sectional view taken in the axial direction of the pipe of FIG. 6.
Figure 8:
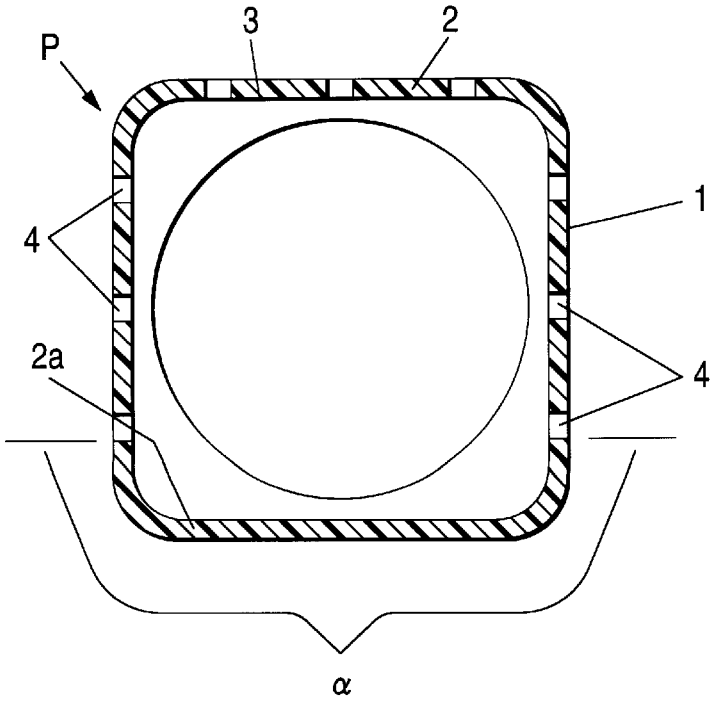
FIG. 8 is a vertical sectional view of a sectionally rectangular wall portion of the pipe of FIG. 6.

FIGS. 6 to 8 show a pipe of a second embodiment. The pipe P in this second embodiment is different from the pipe of the first embodiment mainly in the structure that a large number of water collecting small holes 4 which are formed in the sectionally circular wall portion 3 in the pipe P of the first embodiment are formed not in the sectionally circular wall portion 3 but in the sectionally rectangular wall portion 2 in the second embodiment. Also in the case of the structure of pipe according to this second embodiment, in the same manner as in the first embodiment, these water collecting small holes 4 are not formed in the whole of one flat side 2*a* (lower flat side in FIG. 8) of the sectionally rectangular wall portion 2 and the portion over a predetermined angle region α including the lower portions of vertical flat sides continuous to the opposite sides of the flat side 2*a*, but they are formed only in the portion other than this angle region α, that is, in the rest portion of the opposite vertical flat sides and in the upper flat side.

Figure 9:
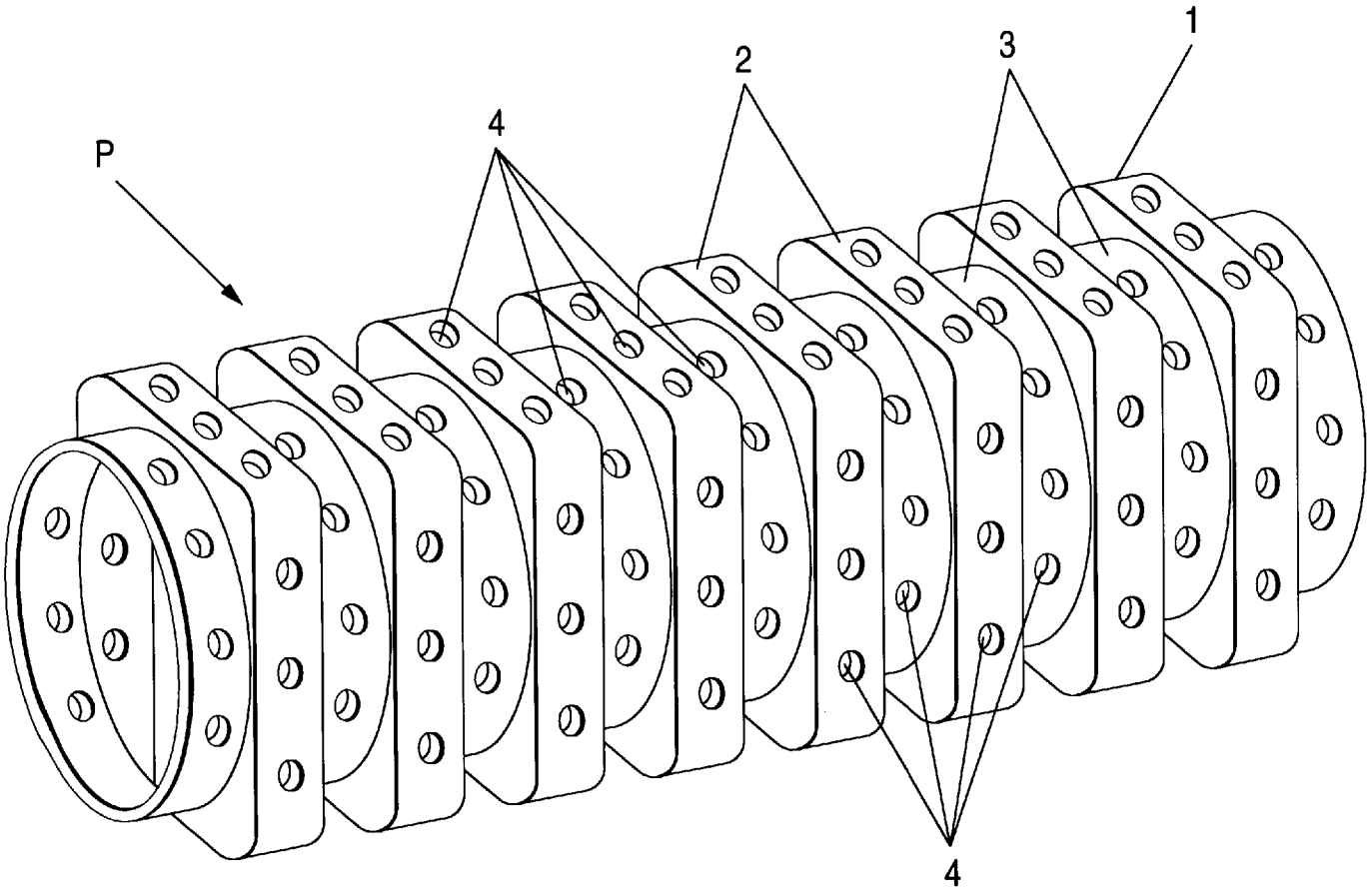
FIG. 9 is a perspective view of a pipe showing a third embodiment.

FIG. 9 shows a pipe P of a third embodiment. The pipe P of this third embodiment has such a structure that a large number of water collecting small holes 4 are formed both in the sectionally circular wall portions 3 and in the sectionally rectangular wall portions 2. Also in the case of the structure of this embodiment, in the same manner as in the first and second embodiments, these water collecting small holes 4 are not formed in the whole of the lower flat side 2*a* of the sectionally rectangular wall portion 2 and the portion of a predetermined angle region including the lower portions of vertical flat sides continuous to the opposite sides of the flat side 2*a* in each of the sectionally rectangular wall portions 2, and the water collecting small holes 4 are not formed in a predetermined angle region of the lower portion of the sectionally circular wall portion 3 correspondingly to the sectionally rectangular wall portion 2 in each of the sectionally circular wall portions 3.

Figure 10:
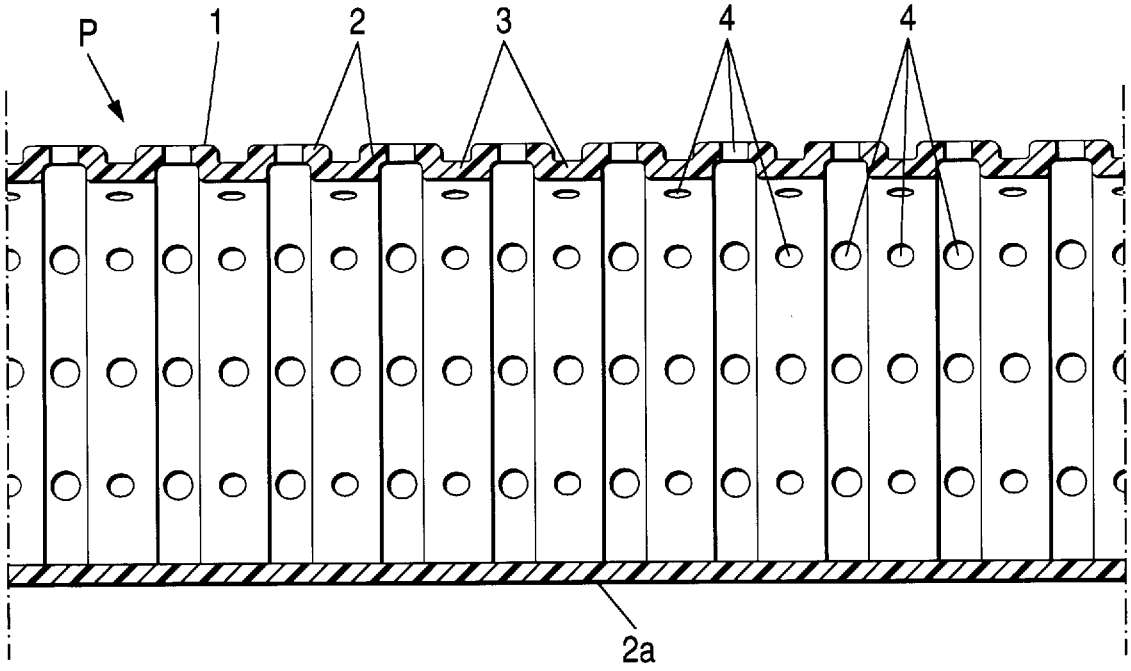
FIG. 10 is a center vertical sectional view taken in the axial direction of the pipe of FIG. 9.
Figure 11:
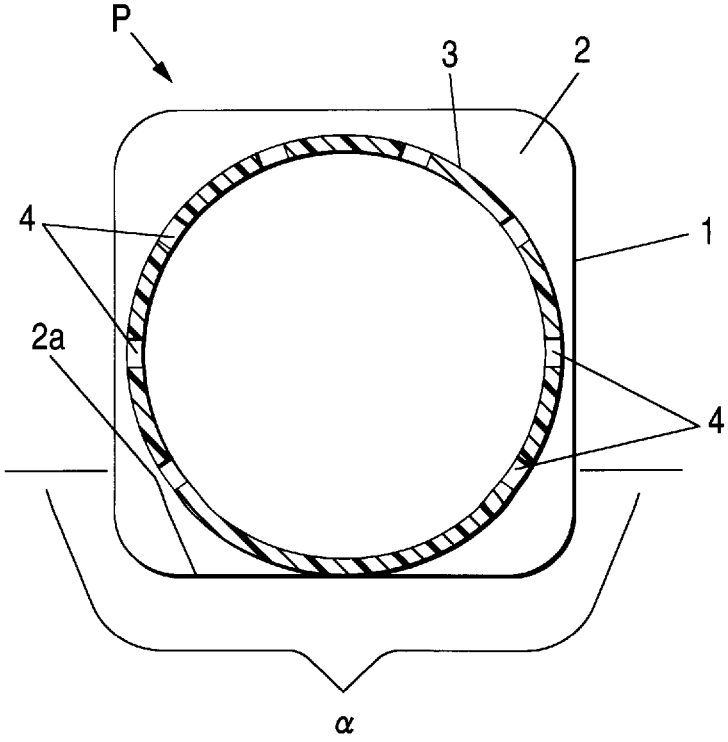
FIG. 11 is a vertical sectional view of a sectionaly circular wall portion of a pipe according to a fourth embodiment.

FIGS. 10 and 11 show a pipe P of a fourth embodiment. The pipe P in this embodiment has such a structure that the center of the sectionally circular wall portion 3 is displaced to one flat side 2*a* side of the sectionally rectangular wall portion 2, that is, to the lower flat side 2*a* side in the drawings with respect to the sectionally rectangular wall portion 2, and the inner surface of the sectionally rectangular wall portion 2 and the inner surface of the sectionally circular wall portion 3 are made substantially even to each other only in these lower portions of the sectionally rectangular wall portion 2 and the sectionally circular wall portion 3. With such a structure, there is an advantage that collected water can be drained with a low resistance. Like this embodiment, it is not necessary to form the sectionally rectangular wall portion 2 and the sectionally circular wall portion 3 concentrically, but the present invention may be carried out with such a structure that the sectionally rectangular wall portion 2 and the sectionally circular wall portion 3 are displaced relatively to each other.

As for the hardness of synthetic resin material forming the pipe P according to the present invention, material having desired hardness may be selectively used in accordance with the size of a pipe to be manufactured, the depth to bury the pipe in the ground, and so on. However, because the pipe is buried in the ground in use, it is preferable to select the kind, hardness and water resistance of the material, taking the external pressure given to the pipe wall 1 into consideration, so that the material has enough flattening pressure resistance.

Although typical embodiments of the present invention have been described above, the invention is not always limited to the structure of the pipe according to these embodiments, and it can be modified and carried out by suitably changing the structure of the pipe within a scope having the constituents stated in the present invention, attaining the above-mentioned objects, and having the following effects.

As is already apparent from the above description, according to the present invention, a pipe wall has a structure that sectionally rectangular wall portions and sectionally circular wall portions are arranged alternately in the longitudinal direction of the pipe, a large number of water collecting small holes are formed in this pipe wall portion, and the whole of the pipe is formed of synthetic resin material or rubber material. Accordingly, there are remarkable advantages such that the pipe can be subjected to piping stably on the bottom surface of ditch made in the ground when the pipe is buried and subjected to piping in the ground, the pipe can be positioned easily, and the posture of the pipe subjected to piping can be kept easily in the state where the pipe is not out of position or twisted easily after the pipe is subjected to piping.

In addition, there are effects from the point of manufacture that the pipe can be manufactured efficiently at a high speed, and the pipe can be manufactured easily without increasing the cost in comparison with a pipe having a conventional structure.

What is claim is:

1. An underdrain pipe, comprising:

a pipe wall including sectionally rectangular wall portions and sectionally circular wall portions disposed alternately in a longitudinal direction of said pipe, said pipe wall having a number of water collecting holes disposed in said pipe wall, each of said sectionally rectangular wall portions and said sectionally circular wall portions having inner surfaces disposed to form a substantially uniform bottom inner surface of said pipe for transporting a fluid therethrough in a continuous manner, wherein said substantially uniform bottom inner surface of said pipe for transporting a fluid, the inner surface of said sectionally rectangular wall portions and said inner surface of said sectionally circular wall portions are on a same plane.

2. The underdrain pipe as in claim 1, wherein each of said sectionally rectangular wall portions has a shape of an approximate square with arcuate corners.

3. The underdrain pipe as in claim 1, wherein said number of water collecting hoes are disposed in said sectionally circular wall portions of said pipe wall.

4. The underdrain pipe as in claim 1, wherein said number of water collecting holes are disposed in said sectionally rectangular wall portions of said pipe wall.

5. The underdrain pipe as in claim 1, wherein said number of water collecting holes are disposed in said sectionally rectangular wall portions and said circular wall portions of said pipe wall.

6. The underdrain pipe as in claim 1, wherein said number of water collecting holes are disposed in said pipe wall except in a bottom flat side of each of said sectionally rectangular wall portions and a bottom portion of each of said sectionally circular wall portions.

7. The underdrain pipe as in claim 6, wherein at least one of said sectionally rectangular wall portions stabilize a position of said pipe so that a fluid passing through said pipe does not exit through said water collecting holes.

8. The underdrain pipe as in claim 1, wherein said pipe wall is made of a material selected from the group consisting of synthetic resin and rubber.

9. The underdrain pipe as in claim 1, wherein said substantially uniform inner surface of said pipe transports said fluid through the pipe without stagnation under low resistance conditions.

10. The underdrain pipe according to claim 1, wherein a center axis defined by said sectionally rectangular wall portions and extending in the longitudinal direction of said pipe is accentrically aligned with a center axis defined by said sectionally circular wall portions and extending in the longitudinal direction.

11. An underdrain pipe, comprising:

a pipe wall including sectionally rectangular wall portions and sectionally circular wall portions disposed alternately in a longitudinal direction of said pipe, said pipe wall having a number of water collecting holes disposed in said pipe wall, in which said sectionally rectangular wall portions and said sectionally circular wall portions are integrally and continuously formed by a material selected from a group consisting of synthetic resin and rubber, wherein each of said sectionally rectangular wall portions and said sectionally circular wall portions have inner surfaces on a same plane which are disposed to form a substantially uniform bottom inner surface of said pipe for transporting a fluid therethrough in a continuous manner.

12. The underdrain pipe according to claim 11, wherein each of said sectionally rectangular wall portions has a shape of an approximate square with arcuate corners.

13. The underdrain pipe according to claim 11, wherein said substantially uniform inner surface of said pipe transports said fluid through the pipe without stagnation under a low resistance condition.

14. The underdrain pipe according to claim 11, wherein the number of water collecting holes are disposed in the sectionally circular wall portions of said pipe wall.

15. The underdrain pipe according to claim 11, wherein the number of water collecting holes are disposed in the sectionally rectangular wall portions of said pipe wall.

16. The underdrain pipe according to claim 11, wherein the number of water collecting holes are disposed in the sectionally circular wall portions and the sectionally rectangular wall portions of said pipe wall.

17. The underdrain pipe according to claim 11, wherein the number of water collecting holes are disposed in said pipe wall except in a bottom flat side of each of said sectionally rectangular wall portions and a bottom portion of each of said sectionally circular wall portions.

18. The underdrain pipe according to claim 17, wherein at least one of said sectionally rectangular wall portions stabilize a position of said pipe so that a fluid passing through said pipe does not exit through said water collecting holes.

19. The flexible underdrain pipe according to claim 11, wherein a center axis defined by said sectionally rectangular wall portions and extending in the longitudinal direction of said pipe is accentrically aligned with a center axis defined by said sectionally circular wall portions and extending in the longitudinal direction.

20. An underdrain pipe comprising:

a pipe wall including sectionally rectangular wall portions and sectionally circular wall portions disposed alternately in a longitudinal direction of said pipe, said pipe wall having a number of water collecting holes disposed in said pipe wall, wherein:

said sectionally rectangular wall portions and said sectionally circular wall portions are integrally and continuously formed by a material selected from the group consisting of synthetic resin and rubber, said number of water collecting holes are disposed in said pipe wall except in a bottom flat side of each of said sectionally rectangular wall portions and a bottom portion of each of said sectionally circular wall portions, and each of said sectionally rectangular wall portions and said sectionally circular wall portions have inner surfaces on a same plane which are disposed to form a substantially uniform bottom inner surface of said pipe for transporting a fluid therethrough in a continuous manner.

21. A method for manufacturing a underdrain pipe as recited in claim 20, said method comprising:

forming said water collecting holes after molding and solidifying a pipe blank having said sectionally rectangular wall portions and sectionally circular wall portions except for the water collecting holes.

22. An underdrain pipe, comprising a pipe wall including sectionally rectangular wall portions and substantially sectionally circular wall portions disposed alternately in a longitudinal direction of said pipe, said pipe wall having a number of water collecting holes disposed in said pipe wall, said sectionally rectangular wall portions and substantially sectionally circular wall portions having lower flat sides residing on a same plane which form an even inner surface of said pipe for transporting fluid therethrough in a continuous manner.

* * * * *